US009284804B2

(12) United States Patent
Lovik

(10) Patent No.: US 9,284,804 B2
(45) Date of Patent: Mar. 15, 2016

(54) METHOD AND APPARATUS FOR LOCAL SUPPLY OF A TREATMENT FLUID TO A WELL PORTION

(75) Inventor: Reidar Lovik, Rennesoy (NO)
(73) Assignee: Archer Norge AS, Stavanger (NO)

( * ) Notice: Subject to any disclaimer, the term of this patent is extended or adjusted under 35 U.S.C. 154(b) by 324 days.
(21) Appl. No.: 14/001,717
(22) PCT Filed: Feb. 23, 2012
(86) PCT No.: PCT/NO2012/050027
§ 371 (c)(1),
(2), (4) Date: Oct. 24, 2013
(87) PCT Pub. No.: WO2012/118384
PCT Pub. Date: Sep. 7, 2012
(65) Prior Publication Data
US 2014/0041873 A1 Feb. 13, 2014
(30) Foreign Application Priority Data
Feb. 28, 2011 (NO) ..... 20110317
(51) Int. Cl.
*E21B 27/02* (2006.01)
*E21B 37/06* (2006.01)
*E21B 34/10* (2006.01)
(52) U.S. Cl.
CPC ..... *E21B 27/02* (2013.01); *E21B 34/105* (2013.01); *E21B 37/06* (2013.01)
(58) Field of Classification Search
CPC ..... E21B 27/02; E21B 34/105; E21B 37/06; E21B 27/00
See application file for complete search history.

(56) References Cited

U.S. PATENT DOCUMENTS 1,672,275 A 6/1928 Neilson
3,020,961 A 2/1962 Orr
3,108,024 A * 10/1963 Battle ..... E21B 27/02 118/408
3,199,596 A 8/1965 Wood
3,273,647 A * 9/1966 Briggs, Jr. ..... E21B 43/117 166/100
3,473,611 A * 10/1969 Gregston ..... E21B 27/02 166/310
3,614,988 A * 10/1971 Moore ..... E21B 27/02 166/164
4,421,166 A * 12/1983 Cain ..... E21B 27/02 166/162
4,739,829 A 4/1988 Brunner
4,741,396 A * 5/1988 Falxa ..... E21B 27/02 166/169
5,533,570 A * 7/1996 Streich ..... E21B 27/02 166/153

(Continued)

FOREIGN PATENT DOCUMENTS

EP 1 223 303 A1 7/2002

OTHER PUBLICATIONS

International Search Report for parent application PCT/NO2012/050027, having a mailing date of May 30, 2012.
Written Opinion for parent application PCT/NO2012/050027, having a mailing date of May 30, 2012.
Applicant's Reply of Oct. 11, 2012, to Written Opinion for parent application PCT/NO2012/0500277 of May 30, 2012.
International Preliminary Report for parent application PCT/NO2012/050027, having a completion date of Apr. 3, 2013.

*Primary Examiner* — Daniel P Stephenson
(74) *Attorney, Agent, or Firm* — Andrus Intellectual Property Law, LLP

(57) ABSTRACT

An apparatus is for supplying a treatment fluid to a well portion. A container is provided with a fluid chamber which is in closable fluid communication with at least one first outlet, the fluid chamber being defined by front and rear pistons. The front piston, in a starting position, forms a fluid barrier between the fluid chamber and the at least one first outlet, and the rear piston is provided with a rear piston rod projecting from a rear container end. A method is for supplying a treatment fluid to a well portion.

14 Claims, 3 Drawing Sheets

(56) References Cited

U.S. PATENT DOCUMENTS 5,582,251 A * 12/1996 Bailey ..... E21B 27/02 166/162
6,533,036 B1 * 3/2003 Baret ..... E21B 33/138 166/290
8,813,841 B2 * 8/2014 Carisella ..... E21B 27/02 166/162
2008/0245569 A1 10/2008 Nold et al.
2009/0294133 A1 * 12/2009 Shindgikar ..... E21B 27/02 166/374
2010/0122814 A1 5/2010 Picou
2010/0155054 A1 6/2010 Innes et al.
2010/0262125 A1 * 10/2010 Matusch ..... A61M 5/1782 604/518
2012/0090835 A1 * 4/2012 Kefi ..... E21B 27/02 166/252.6
2014/0041873 A1 * 2/2014 Lovik ..... E21B 27/02 166/304

* cited by examiner

METHOD AND APPARATUS FOR LOCAL SUPPLY OF A TREATMENT FLUID TO A WELL PORTION

CROSS-REFERENCE TO RELATED APPLICATIONS

This application is the U.S. national stage application of International Application No. PCT/NO2012/050027, filed Feb. 23, 2012, which International application was published on Sep. 7, 2012 as International Publication No. WO 2012/118384 A1 in the English language and which application is incorporated herein by reference. The International application claims priority of Norwegian Patent Application No. 20110317, filed. Feb. 28, 2011, which application is incorporated herein by reference.

BACKGROUND

An apparatus for supplying a treatment fluid to a well portion is described, in which a container is provided with a fluid chamber which is in closable fluid communication with at least one first outlet. A method of supplying a treatment fluid to a well portion is described as well.

During the production of hydrocarbons, scaling often occurs in pipe bores and passages of different types. Especially when this occurs in downhole installations, it may have serious consequences as the scaling may block the production. Therefore, great efforts are made to prevent or mitigate scaling. If scaling has been established, chemical treatment will often be a preferred alternative to remedy the situation. The drawbacks of chemical treatment, especially acid treatment, are large. Acid treatment may cause great corrosion damage in well installations, for example. This is not least due to the fact that the acid is often pumped down the wellbore as a so-called "pill", that is to say an amount of acid is brought into a well pipe and is followed by some other well fluid which forces the acid volume forward in the pipe until it has reached its destination. After the prescribed treatment time is up, the acid volume is forced out of the well again. During such treatment, all the well components that get into contact with the acid are subjected to corrosion. Acid may also be forced into the formations around the well, damaging them. The corrosion damage may lead to functional faults in equipment and, at worst, there may be blowouts or other incidents that destroy the well and harm the environment.

To be able to transport smaller volumes of chemicals to a treatment point, a so-called "dump bailer" is often used, that is to say a container that, in a given position, may discharge a volume by a discharging mechanism being activated.

From US2010/0155054, a dump bailer is known, including a chamber holding the material to be discharged, and an outlet for the material. The chamber also includes a movable piston assembly, enclosed in which there is a volume of pressurized fluid, and this may be released via a controllable valve and push a piston against the material so that this is forced out of the outlet.

EP 1223303 discloses an apparatus and a method for injecting a treatment fluid into a subterranean well. A pressure applied to the apparatus through a pipe carrying the apparatus into the well activates a piston which forces the treatment fluid out of the apparatus into the well. The apparatus may include several fluid chambers for selective, incremental ejection of the fluid and treatment of one or more zones within the well.

From US 2010/122814, a cable-operated apparatus for placing drilling mud in a well is known. The apparatus includes a container holding the drilling mud. The container is attached to and may be detached from a packer. At a predefined pressure, a discharge valve activates a cross-over tool which is operatively connected to the valve. Activation of the valve provides for the drilling mud to pass into and through the cross-over tool and be discharged into the well.

SUMMARY

The invention has for its object to remedy or reduce at least one of the drawbacks of the prior art or at least provide a useful alternative to the prior art.

The object is achieved through features that are specified in the description below and in the claims that follow.

The invention provides an apparatus arranged to supply treatment fluid locally to a well portion, the apparatus meeting the requirements of various specifications of so-called TRSCSSVs, that is to say Tubing-Retrievable Surface-Controlled Subsurface Safety Valves. A method of supplying treatment fluid locally to a well portion is provided as well.

In the further description, the terms "front", "rear", "forwards" and "rearwards" are related to the moving direction of the apparatus as it is being run into a well or the like.

The apparatus is preferably cylindrical and provided, at a front end portion, with a sealing device arranged to fit tightly against a portion of a well element, typically a portion of a valve. The sealing device may be formed of several circular, concentric discs spaced apart on an end section on the extension of a container body arranged centrally. Externally, the apparatus is provided with a non-fluid-sealing abutment portion arranged to abut against a seat arranged in said well element, the abutment portion typically being provided as a projection near the rear end of the container.

A container extending rearwards from the end section accommodates a front piston and a rear piston which, together with the container, define a fluid chamber, the pistons fitting tightly against an internal container wall. Projecting from the rear piston through a rear container end, there is a rear piston rod arranged to be connected to a means of conveyance arranged to carry the apparatus into and out of a wellbore, typically a cable or coiled tubing. The rear piston rod exhibits a cross section which lies substantially close to the cross section of the piston as it is favourable that no fluid volume of significance will form behind the rear piston as it is being pushed forwards.

In a front portion, the container is provided with at least one first outlet which puts the fluid chamber, when the front piston has been displaced to a front end position, into fluid communication with the surroundings of the apparatus.

In a starting position, the front piston is releasably anchored to the container by one or more shear pins, shear bolts or the like projecting from the internal wall surface of the container into corresponding cut-outs in the piston.

A front piston rod of a diameter considerably smaller than the piston diameter projects forwards from the rear piston into the fluid chamber, it being arranged, by abutment against the front piston, to push this into its front end position in the front end portion of the container, typically into abutment against a portion of the end section. The front piston rod is arranged in a cut-out extending through the rear piston into the rear piston rod by a length sufficient to accommodate the front piston rod in its entirety. A breakable anchoring of the front piston rod to the rear piston is formed, for example by means of one or more shear pins, shear bolts or the like.

A breakable anchoring of the rear piston to the container is provided when the piston is in a retracted, rear starting position. The anchoring is formed by one or more shear pins, shear bolts or the like projecting from the internal container wall into corresponding cut-outs in the rear piston. The breakable connection is dimensioned to break when the apparatus is supported in the seat of the well element and a prescribed pushing force is applied to the rear piston rod.

In one embodiment, the rear piston is provided with a filling passage extending from an inlet arranged at the periphery of a portion of the rear piston that is outside the rear end portion of the container in the starting position of the piston to an outlet which is in fluid communication with the fluid chamber. The inlet is arranged to be connected to an external fluid system. Correspondingly, a draining passage is formed in the rear piston, an external outlet being arranged to be connected to an external overflow vessel.

The anchorings mentioned are dimensioned in such a way that the anchoring of the front piston rod can take greater strain than the anchoring of the pistons, so that the piston anchorings will break first, and then the anchoring of the front piston rod will break, after the front piston has reached its end position, thereby having provided fluid communication between the fluid chamber and the surroundings through the at least one first outlet.

When the rear piston is placed in its retracted starting position, the front piston preferably abuts against the front end of the front piston rod. The fluid chamber is filled with a treatment fluid of a prescribed type through the filling passage of the rear piston. The apparatus is then carried into the well until the abutment portion abuts against the seat of the well element. By continued application of pushing force to the apparatus, the anchoring of the rear piston to the container and the anchoring of the front piston to the container will break, and the rear and front pistons are moved forwards within the apparatus until the front piston reaches its end position by abutment against the front end portion of the container, fluid communication being provided between the fluid chamber and the at least one first outlet. The anchoring of the front piston rod to the rear piston breaks, and the rear piston continues to move forwards, the treatment fluid held by the container flowing out through the at least one first outlet and into the surrounding volume within the well element. As the rear piston hits the front piston, the fluid chamber has been emptied of treatment fluid.

In one embodiment, there may be at least one second outlet formed in a rear portion, which is put into fluid communication, via said filling and draining passages, with the fluid chamber as the rear piston has been moved sufficiently forwards in the container, wherein some treatment fluid may flow out via the annular space surrounding the rear piston rod. In the well element to foe treated, this flow of treatment fluid will mix with the fluid flow from the primary, first outlets at the front end portion of the container.

By withdrawal of the apparatus from the well element, the rear piston will be retracted into its starting position, fluid flowing from the surroundings into the fluid chamber. When the apparatus has been pulled out of its liquid-filled surroundings, the container is emptied. Thereby there is no risk that handling a returned apparatus may lead to injury or damage being inflicted on personnel and surface installations by returned fluid containing treatment fluid, which is very often a highly corrosive mixture of liquids.

In a first aspect, the invention relates more specifically to an apparatus for supplying a treatment fluid to a well portion, in which a container is provided with a fluid chamber which is in closable fluid communication with at least one first outlet, characterized by the fluid chamber being defined by front and rear pistons, the front piston in a starting position forming a fluid barrier between the fluid chamber and the at least one first outlet, and the rear piston being provided with a rear piston rod projecting from a rear container end.

In their starting positions, the front and rear pistons may be releasably fixed to the container by means of breakable anchorings.

A front piston rod projecting from the rear piston and being arranged to abut supportingly by a projecting end portion against the front piston may be releasably fixed to the rear piston or the rear piston rod by means of a breakable anchoring.

The rear piston and the rear piston rod may be provided with a cut-out which is arranged to accommodate substantially the entire front piston rod.

A front end section may be provided with a sealing device including means arranged to sealingly abut against the well portion.

The rear piston may be provided with a filling passage and a draining passage, each extending between the fluid chamber and a port which is available from the outside of the apparatus when the rear piston is in a starting position.

The container may be provided with an abutment portion which is arranged to abut supportingly against a seat arranged in the well portion.

The container may be provided with at least one second outlet which is in fluid communication with the fluid chamber through the filling and draining passages of the rear piston.

In a second aspect, the invention relates more specifically to a method of supplying a treatment fluid to a well portion by means of an apparatus including a container forming a fluid chamber defined by front and rear pistons, the container being provided with at least one first outlet, characterized by the method including the following steps:

a) carrying the treatment fluid into the fluid chamber;

b) moving the apparatus into a well which includes the well portion to be treated, and placing the apparatus in the well portion;

c) moving the front piston in order thereby to provide a fluid communication between the fluid chamber and well portion through the at least one first outlet; and d) moving the rear piston towards the front piston in order thereby to empty the fluid chamber through the at least one first outlet.

The front piston may be moved by means of a displacement of the rear piston as a front piston rod, projecting from the rear piston, abuts supportingly against a portion of the front piston.

The rear piston may be moved towards the front piston by an anchoring of the front piston rod to the rear piston or the rear piston rod being broken and the front piston rod being moved into a cut-out in the rear piston and the rear piston rod.

The treatment fluid may be carried into the fluid camber through the following steps:

a1) connecting a fluid source to the port of a filling passage that is accessible from the outside of the apparatus when the rear piston is in a starting position, the filling passage forming a fluid communication with the fluid chamber;

a2) connecting an overflow vessel to the port of a draining passage that is accessible from the outside of the apparatus when the rear piston is in a starting position, the draining passage forming a fluid communication with the fluid chamber;

a3) filling the fluid chamber with treatment fluid through the filling passage until treatment fluid is flowing into the overflow vessel;

a4) reversing the fluid flow until the overflow vessel has been emptied; and a5) disconnecting the fluid source and the overflow vessel from the apparatus.

BRIEF DESCRIPTION OF DRAWINGS

In what follows, an example of a preferred embodiment is described, which is visualized in the accompanying drawings, in which.

DETAILED DESCRIPTION OF THE DRAWINGS

Figure 1:
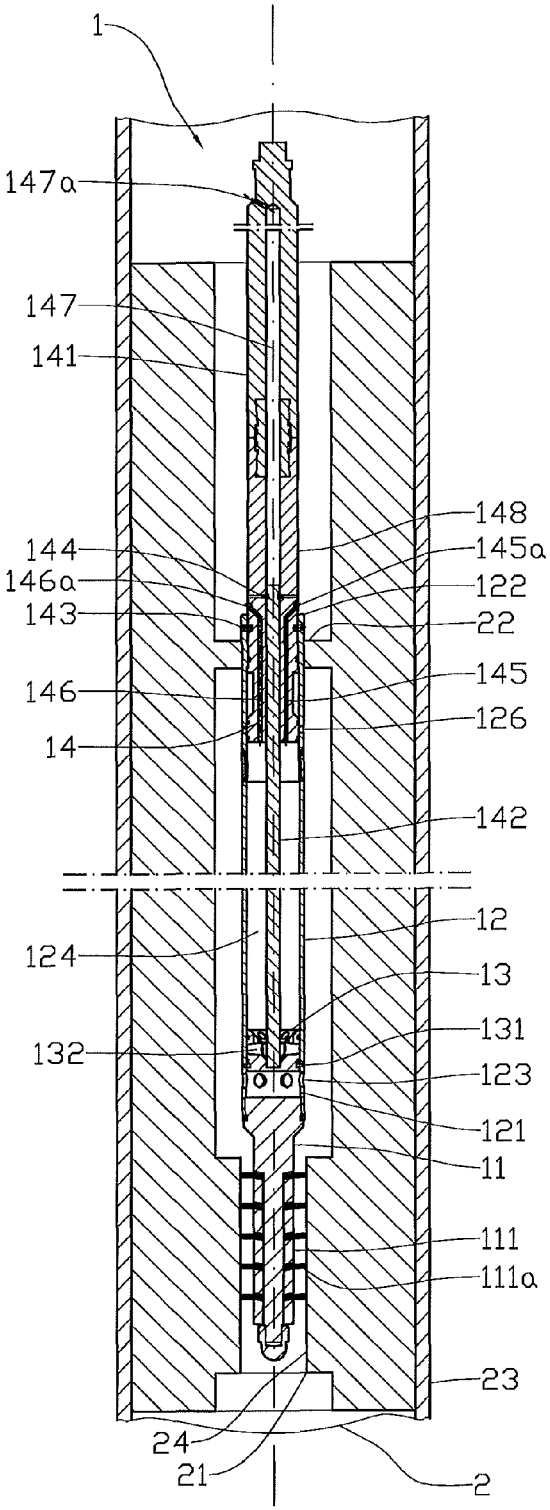
FIG. 1 shows an axial section of a well portion provided with a well element in which an apparatus according to the invention is placed restingly on a seat and with a sealing device fitting tightly against a lower portion of the well element.
Figure 2:
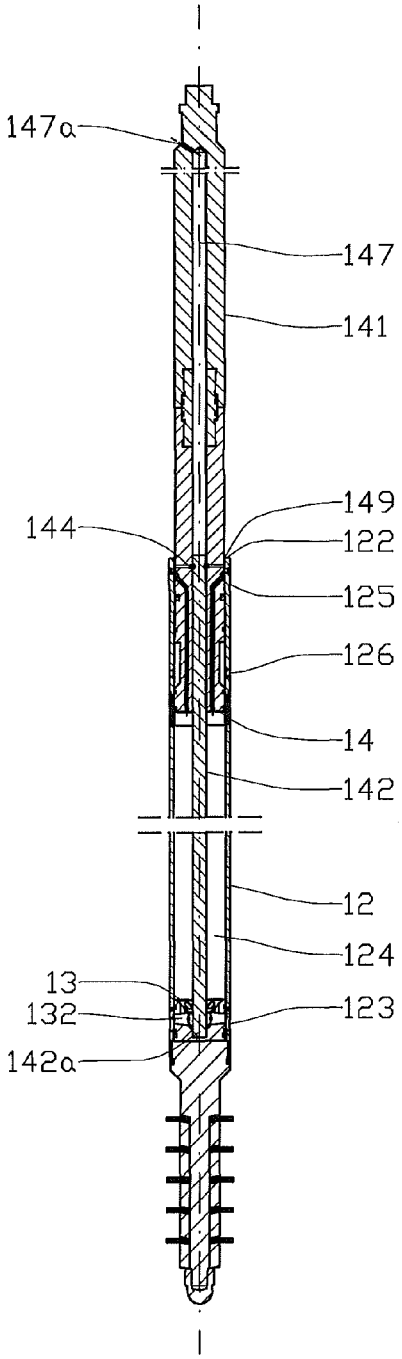
FIG. 2 shows, in an axial section, the apparatus in an initial stage of an emptying operation, a front piston having opened the outlets of a fluid chamber.
Figure 3:
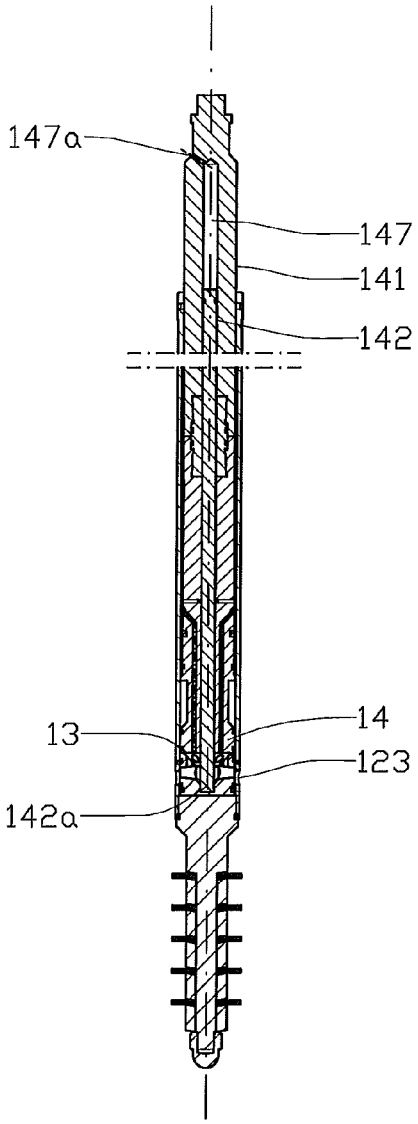
FIG. 3 shows, in an axial section, the apparatus as the emptying operation is ended.
Figure 4:
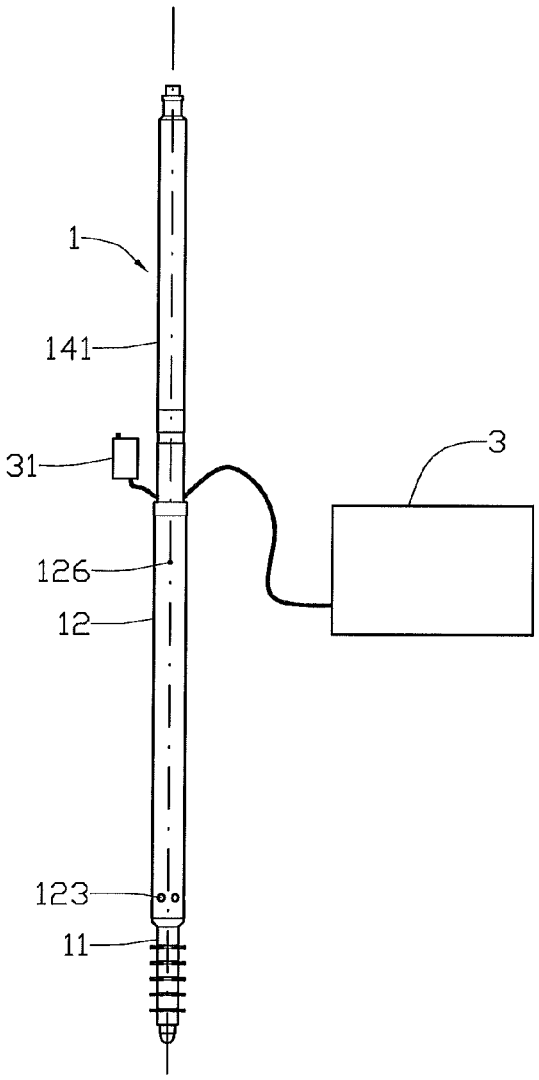
FIG. 4 shows, in a side view and on a smaller scale, a principle drawing of the apparatus connected to a fluid source and an overflow vessel as the fluid chamber is being filled.
Figure 5:
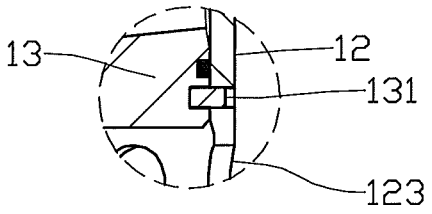
FIG. 5 shows, on a larger scale, a section of the front piston anchored to the container.
Figure 6:
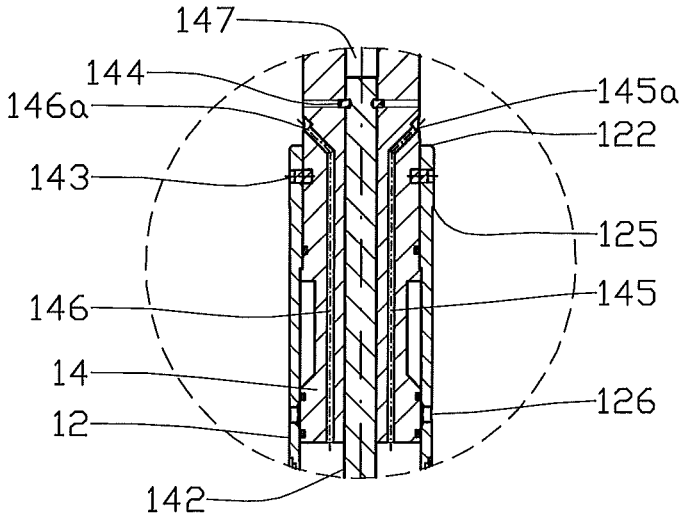
FIG. 6 shows, on a smaller scale, the rear piston in a retracted starting position.

In the figures, the reference numeral 1 indicates an apparatus according to the invention. An end section 11 fits tightly against a front end portion 121 of a container accommodating front and rear pistons 13, 14. Both pistons 13, 14 are axially movable in the container 12 and fit tightly against the internal wall surface of the container 12. The rear piston 14 is provided with a rear piston rod 141 which projects from a rear container end 122 in ail the positions of the piston 14. In an end portion remote from the rear piston 14, the rear piston rod 141 is arranged to engage with a conveyance means (not shown), for example a cable, coiled tubing or the like.

In the front end portion, the container 12 is provided with several first outlets 123. In a starting position, the front piston 13 is positioned in such a way that a fluid chamber 124 formed in the container 12 and defined by the front and rear pistons 13, 14 is not in fluid communication with said first outlets 123. When the front piston 13 has been pushed forward into its end position, shown here as abutment against a portion of the end section 11, fluid communication is provided between the fluid chamber 124 and the surroundings through the first outlets 123, shown here by several flow paths 132, extending from the rear end of the front piston 13 to the circumferential surface of the piston 13, being positioned opposite said first outlets 123.

In its starting position, the front piston 13 is anchored to the container 12 by means of a front piston anchoring 131, shown here as shear bolts extending from the container 12 into cut-outs in the front piston 13.

In a piston-rod cut-out 147 extending through the rear piston 14 and through a substantial part of the rear piston rod 141, a front piston rod 142 is arranged, projecting forwards, in a starting position, from the rear piston 14, a piston-rod end 142*a* abutting against a portion of the front piston 13. The front piston rod 142 is anchored to the rear piston 14 by means of a piston-rod anchoring 144, shown here as shear bolts extending from the rear piston 14 into recesses in the front piston rod 142.

The piston-rod cut-out 147 is provided with a fluid connection 147*a* to the outside of the rear piston rod 141 in order that, in the piston-rod cut-out 147, there will be no build-up of an overpressure that may restrain the movement of the front piston rod 142 relative to the rear piston 14 and the rear piston rod 141.

In its retracted starting position, the rear piston 14 is fixed to the container 12 by means of a rear piston anchoring 143, shown here as shear bolts extending from the container 12 into recesses in the rear piston 14.

The rear piston 14 is provided with a filling passage 145 and a draining passage 146 extending from respective ports 145*a*, 146*a* on a circumferential piston surface 148 to a piston surface facing the fluid chamber 124. The filling and draining passages 145, 146 form a fluid communication between the fluid chamber 124 and the surroundings, directly, in the starting position of the rear piston, and, when the rear piston 14 has been moved forwards within the container 12, via an annular space 149 formed between the rear piston rod 141 and the container 12, and possibly out through one or more second outlets 126 formed in the container 12 near the rear container end 122.

The filling-passage port 145*a* is arranged to be connected to a fluid source 3, and the draining-passage port 146*a* is arranged to be connected, to an overflow vessel 31.

The reference numeral 2 indicates a well, for example an oil well extending downwards in an underground structure and being defined, in a manner known per se, by well pipes 23. In the well, a well element 21, for example a valve, is positioned. The well element 21 is provided with a seat 22 arranged to receive the abutment portion 125 of the container 12. The well element 21 is also provided with a sealing surface 24 arranged for sealing abutment of the sealing discs 111*a* of the end section 11.

The anchorings 131, 143, 144 are dimensioned in such a way that when a pushing force is applied to the rear piston 14 as the container 12 is resting on the seat 22, the anchorings 131, 143 to the container 12 will break first, so that the front piston 13 opens the fluid chamber 124 for fluid to flow out through the first outlets 123 into the surroundings, for example said well element 21. Then, by continued application of pushing force, the first piston 13 having reached its end position and the front piston rod 142 abutting against the front piston 13, the piston-rod anchoring 144 will break and the rear piston 14 continues its forward movement into abutment against the front piston 13, with the result that the fluid chamber 124 is emptied, whereas the front piston rod 142 is moved into the piston-rod cut-out 147.

As the apparatus 1 is being prepared, the fluid chamber 124 is filled with fluid from the fluid source 3, the latter being connected temporarily to the filling port 145*a*. The overflow vessel 31 is connected to the draining port 146*a*. The fluid chamber 124 is filled until the fluid is flowing into the overflow vessel 31. Fluid is then sucked back into the fluid source 3 until the overflow vessel 31 has been emptied. The risk of the surroundings and the personnel operating the apparatus being damaged or injured by the fluid is thereby reduced.

As the apparatus 1 is being pulled from the well 3, the rear piston 14 may be retracted into its starting position. This means that any liquid possibly surrounding the apparatus 1 will be sucked into the fluid chamber 124, possibly filling up the annular space 149 and the filling and draining passages 145, 146. Once the apparatus has been pulled away from liquid-filled portions of the well 3, the liquid present in the apparatus 1 will be drained out through the first outlets 123 by the fluid chamber 124 being vented through the filling and draining passages 145, 146. Thereby the risk of the surroundings and the personnel operating the apparatus being damaged or injured by fluid from the well is reduced.

The invention claimed is:

1. An apparatus for supplying a treatment fluid to a well portion, the apparatus comprising a container provided with a fluid chamber which is in closable fluid communication with at least one first outlet, wherein the fluid chamber is defined by front and rear pistons, the front piston, in a starting position, providing a fluid barrier between the fluid chamber and the at least one first outlet, the rear piston being provided with a rear piston rod projecting from a rear container end, wherein a front piston rod projecting from the rear piston and being arranged to abut supportingly by a projecting end portion against the front piston, is releasably fixed to at least one of the rear piston and the rear piston rod by a breakable anchoring, wherein the front piston rod is received in both the rear piston and the rear piston rod.

2. The apparatus in accordance with claim 1, wherein, in starting positions, the front and rear pistons are releasably fixed to the container by means of breakable anchorings.

3. The apparatus in accordance with claim 1, wherein the rear piston and the rear piston rod are provided with a cut-out which is arranged to accommodate substantially all of the front piston rod.

4. The apparatus in accordance with claim 1, wherein a front end section is provided with a sealing device which includes means arranged to abut in a fluid-sealing manner against the well portion.

5. The apparatus in accordance with claim 1, wherein the rear piston is provided with a filling passage and a draining passage, each extending from the fluid chamber to a port which is accessible from the outside of the apparatus when the rear piston is in a starting position.

6. The apparatus in accordance with claim 5, wherein the container is provided with at least one second outlet which is in fluid communication with the fluid chamber through the filling and draining passages of the rear piston.

7. The apparatus in accordance with claim 1, wherein the container is provided with an abutment portion which is arranged to abut supportingly against a seat arranged in the well portion.

8. The apparatus in accordance with claim 1, wherein the rear piston is configured for abutment with the front piston.

9. The apparatus in accordance with claim 1, wherein the well portion is a valve positioned within a well pipe and formed with an interior in communication with the at least one fluid outlet.

10. The apparatus in accordance with claim 1, wherein the front piston remains completely surrounded by the container.

11. A method of supplying a treatment fluid to a well portion by an apparatus which includes a container forming a fluid chamber defined by front and rear pistons, the container being provided with at least one first outlet, the method comprising:

a) carrying the treatment fluid into the fluid chamber;

b) moving the apparatus into a well which includes the well portion to be treated, and positioning the apparatus in the well portion;

c) moving the front piston in order thereby to provide a fluid communication between the fluid chamber and the well portion through the at least one first outlet; and d) moving the rear piston towards the front piston in order thereby to empty the fluid chamber through the at least one first outlet;

e) moving the rear piston towards the front piston by breaking an anchoring of a front piston rod to at least one of the rear piston and the rear piston rod, the front piston rod, projecting from the rear piston, being moved into a cut-out in the rear piston and the rear piston rod.

12. The method in accordance with claim 11, wherein the front piston is moved by means of a displacement of the rear piston, the front piston rod supportingly abutting against a portion of the front piston.

13. The method in accordance with claim 11, wherein the treatment fluid is carried into the fluid chamber through the following:

a1) connecting a fluid source to the port of a filling passage, which is accessible from the outside of the apparatus when the rear piston is in a starting position, the filling passage forming a fluid communication with the fluid chamber;

a2) connecting an overflow vessel to the port of a draining passage, which is accessible from the outside of the apparatus when the rear piston is in a starting position, the draining passage forming a fluid communication with the fluid chamber;

a3) filling the fluid chamber with treatment fluid through the filling passage until treatment fluid is flowing into the overflow vessel;

a4) reversing the fluid flow until the overflow vessel has been emptied; and a5) disconnecting the fluid source and the overflow vessel from the apparatus.

14. An apparatus for supplying a treatment fluid to a well portion, the apparatus comprising a container provided with a fluid chamber which is in closable fluid communication with at least one first outlet, wherein the fluid chamber is defined by front and rear pistons, the front piston, in a starting position, providing a fluid barrier between the fluid chamber and the at least one first outlet, the rear piston being provided with a rear piston rod projecting from a rear container end, wherein a front piston rod projecting from the rear piston and being arranged to abut supportingly by a projecting end portion against the front piston, is releasably fixed to at least one of the rear piston and the rear piston rod by a breakable anchoring, wherein the rear piston is provided with a filling passage and a draining passage, each extending from the fluid chamber to a port which is accessible from the outside of the apparatus when the rear piston is in a starting position.

* * * * *